US008057202B2

(12) United States Patent
Haller

(10) Patent No.: US 8,057,202 B2
(45) Date of Patent: Nov. 15, 2011

(54) TIP SEAL FOR A SCROLL COMPRESSOR

(75) Inventor: David K. Haller, Adrian, MI (US)

(73) Assignee: Tecumseh Products Company, Ann Arbor, MI (US)

( * ) Notice: Subject to any disclaimer, the term of this patent is extended or adjusted under 35 U.S.C. 154(b) by 412 days.

(21) Appl. No.: 12/254,278

(22) Filed: Oct. 20, 2008

(65) Prior Publication Data

US 2009/0104061 A1 Apr. 23, 2009

Related U.S. Application Data

(60) Provisional application No. 60/981,846, filed on Oct. 23, 2007.

(51) Int. Cl.
*F03C 4/00* (2006.01)
*F04C 18/00* (2006.01)
*F04C 2/00* (2006.01)

(52) U.S. Cl. ..... 418/55.4; 418/55.1; 418/142; 277/394; 277/397; 277/549

(58) Field of Classification Search .... 418/1, 55.1–55.6, 418/140, 142; 277/397, 394, 402, 549, 562–564
See application file for complete search history.

(56) References Cited

U.S. PATENT DOCUMENTS

| | | | | |
|---|---|---|---|---|
| 3,149,849 | A * | 9/1964 | Baldridge | 277/589 |
| 4,013,299 | A * | 3/1977 | Scott | 277/556 |
| 4,655,697 | A | 4/1987 | Nakamura et al. | |
| 4,732,550 | A | 3/1988 | Suzuki et al. | |
| 5,636,976 | A * | 6/1997 | Niwa et al. | 418/55.4 |
| 5,767,186 | A * | 6/1998 | Shimokusuzono et al. | 524/502 |
| 7,293,969 | B2 | 11/2007 | Midorikawa | |
| 2007/0071626 | A1 | 3/2007 | Tsuchiya et al. | |

FOREIGN PATENT DOCUMENTS

| | | | | |
|---|---|---|---|---|
| JP | 63-55301 | | 3/1988 | |
| JP | 6-137285 | | 5/1994 | |
| JP | 06272679 | A * | 9/1994 | 418/55.4 |
| JP | 11351165 | A * | 12/1999 | |
| JP | 2002266778 | A * | 9/2002 | |
| JP | 2007-146756 | | 6/2007 | |

OTHER PUBLICATIONS

Foreign patent document together with English language abstract.
Office Action dated Sep. 13, 2010 in corresponding Canadian Application No. 2,641,765.
Japanese patent document with English language abstract.

* cited by examiner

*Primary Examiner* — Theresa Trieu
(74) *Attorney, Agent, or Firm* — Baker & Daniels LLP

(57) ABSTRACT

A scroll compressor including a non-orbiting and an orbiting scroll member having mating involute wraps extending therefrom. In one exemplary embodiment, at least one of the non-orbiting and orbiting scroll members includes an inner wall forming a groove in an end of the involute wrap and extending substantially entirely along the length thereof. Positioned within the groove is a tip seal having outwardly extending projections configured to engage the inner walls of the involute wrap along at least a portion thereof. In one exemplary embodiment, the tip seal has a length that is less than the length of the groove. As a result, a gap is formed at the innermost portion of the involute wrap between the end of the groove and the end of the tip seal.

20 Claims, 6 Drawing Sheets

TIP SEAL FOR A SCROLL COMPRESSOR

CROSS REFERENCE TO RELATED APPLICATIONS

This application claims the benefit under 35 U.S.C. §119 (e) of U.S. Provisional Patent Application Ser. No. 60/981,846, filed Oct. 23, 2007.

BACKGROUND

1. Field of the Invention

The present invention relates to scroll compressors, and more particularly, to tipseals for use with the same.

2. Description of the Related Art

In a typical scroll compressor, a motor and a compression mechanism are mounted within a hermetic housing. The compression mechanism includes a non-orbiting scroll member and an orbiting scroll member each having involute wraps in mating engagement with one another. The orbiting scroll member is connected to and driven by the motor, resulting in orbital movement of the orbiting scroll member. This orbital movement relative to the fixed scroll member creates a plurality of variable-volume working pockets between the wraps of the non-orbiting and orbiting scroll members.

During operation of a scroll compressor, working fluid is received between the involute wraps of the non-orbiting and orbiting scroll members and moved through the plurality of variable-volume working pockets toward to the center of the scroll members, sequentially increasing the pressure of the working fluid. In order to ensure an effective seal between the working pockets and to prevent leakage of the compressed working fluid therebetween, tip seals may be utilized. Tip seals are received within a groove formed in the end of the involute wrap of the non-orbiting and/or orbiting scroll members. By positioning a tip seal in the end of the involute wrap of the non-orbiting and/or orbiting scroll members, the tip seal may contact an end plate of an opposing scroll member to effect a seal between the involute wrap and the opposing scroll member.

Additionally, in order to ensure that the tip seal remains in contact with the end plate of the opposing scroll member, the tip seal may be slightly undersized relative to the groove in which it is received. As a result, pressurized working fluid from opposing sides of the involute wrap of the scroll member is received within the groove, which, in turn, biases the tip seal upward against the end plate of the opposing scroll member. However, by utilizing working fluid from opposing sides of the scroll member to bias the tip seal, the efficiency of the compressor is reduced. Specifically, the working fluid may travel through the groove from a higher pressure working pocket on one side of a scroll member to a lower pressure working pocket on an opposing side of a scroll member.

What is needed in the art is an improvement over the foregoing.

SUMMARY

The scroll compressor of the present invention includes a non-orbiting and an orbiting scroll member having mating involute wraps extending therefrom. In one exemplary embodiment, at least one of the non-orbiting and orbiting scroll members includes an inner wall forming a groove in an end of the involute wrap and extending substantially entirely along the length thereof. Positioned within the groove is a tip seal having an outwardly extending projection configured to engage the inner wall of the involute wrap along at least a portion thereof. In one exemplary embodiment, the tip seal has a length that is less than the length of the groove. As a result, a gap is formed at the innermost portion of the involute wrap between the end of the groove and the end of the tip seal.

During operation of the compressor, discharge pressure working fluid is received within the groove and travels there along below the projection of the tip seal. The pressure of the discharge pressure working fluid within the groove biases the tip seal toward an end plate of the opposing scroll member. In this manner, a substantially fluid tight seal is maintained between the projection of the tip seal and the inner wall of the non-orbiting and/or orbiting scroll member. Advantageously, by utilizing the discharge pressure working fluid, the need to provide working fluid from opposing sides of a scroll member is eliminated. As a result, the working fluid cannot travel from a higher pressure working pocket to a lower pressure working pocket, thereby increasing the efficiency of the compressor.

In one form thereof, the present invention provides a compressor mechanism, including a motor including a stator and a rotor; a driveshaft rotatably secured to the rotor; and a compression mechanism including a fixed scroll and an orbiting scroll, the orbiting scroll rotatably connected to the rotor, at least one of the fixed scroll and the orbiting scroll having a plurality of walls defining a groove, a tip seal sized for receipt within said groove, the tip seal having a projection extending therefrom, the projection configured to sealingly engage the walls defining the groove.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
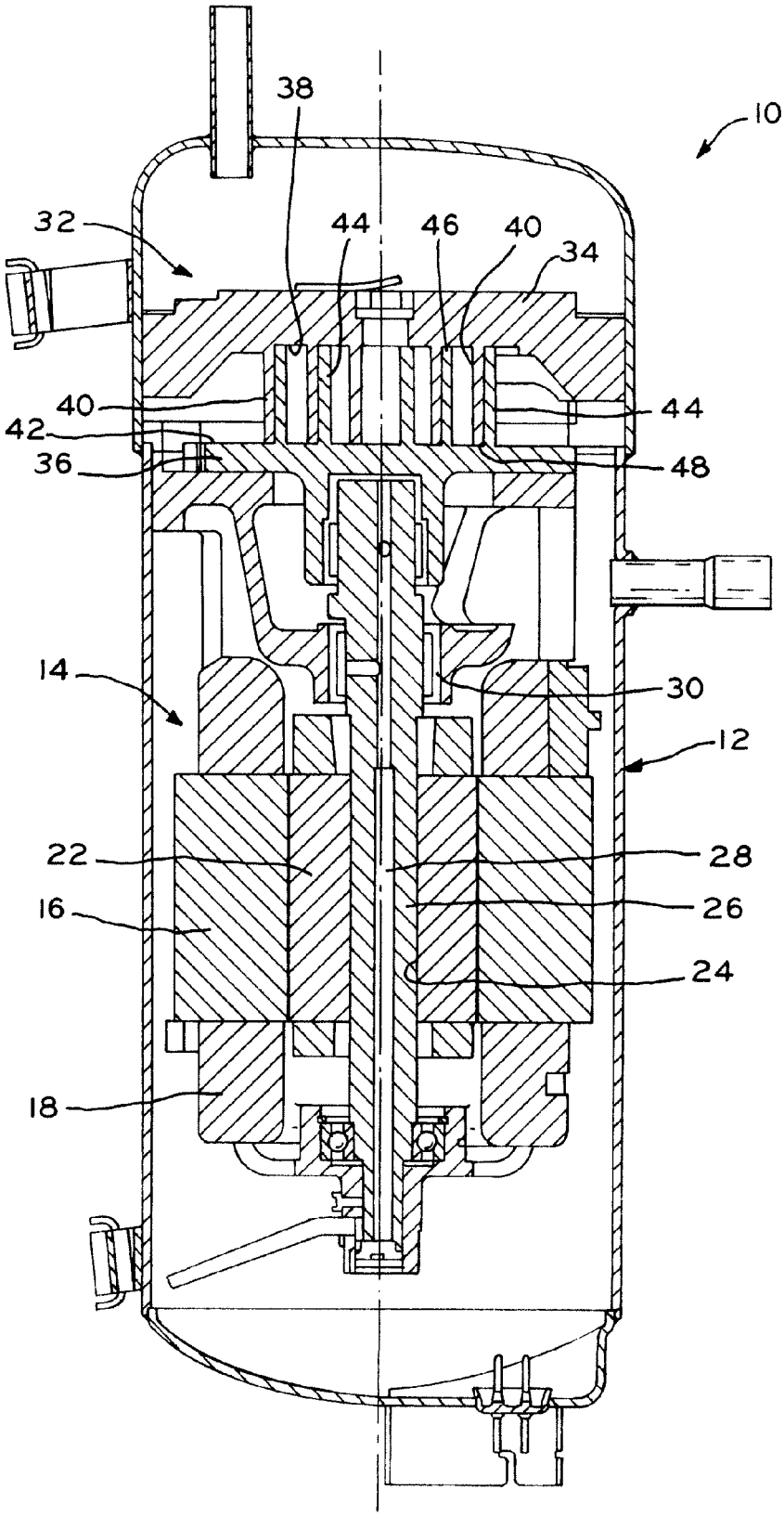
FIG. 1 is a cross-section of a scroll compressor.

Referring to FIG. 1, scroll compressor 10 is shown including housing 12, which is hermetically sealed by traditional methods, such as welding or brazing. Motor 14 is disposed within housing 12 and includes stator 16 that is secured to housing 12 in a conventional manner. Stator 16 comprises windings 18 through which electrical current is passed. Rotor 22 of motor 14 is rotatably disposed within stator 16. Rotor 22 includes central aperture 24 through which driveshaft 26 extends. Driveshaft 26 is rotationally fixed to rotor 22, such as by an interference fit. Extending through driveshaft 26 and into an oil sump (not shown) in the lower portion of housing 12 is longitudinal oil passage 28. During operation of compressor 10, oil is drawn through oil passage 28 and delivered to main bearing 30 and other areas of scroll compression mechanism 32.

Compression mechanism 32 includes non-orbiting scroll member 34 and orbiting scroll member 36. Non-orbiting scroll member 34 is secured to housing 12 in a known manner and includes a generally planar portion having flat end surface 38 from which involute non-orbiting scroll wrap 40 extends. Similarly, orbiting scroll member 36 includes flat end surface 42 from which involute orbiting scroll wrap 44 extends. Tips 46, 48 of non-orbiting and orbiting scroll wraps 40, 44 slidingly engage flat end surfaces 38, 42 of non-orbiting and orbiting scroll members 34, 36, respectively. Additionally, the lateral sides of non-orbiting and orbiting scroll wraps 40, 44 mate with each other to define a plurality of variable-volume working pockets between the interweaved scroll wraps.

During operation of motor 14, rotor 22 drives driveshaft 26 which correspondingly orbits orbiting scroll member 36. The motion of orbiting scroll member 36 results in progressive compression of a working fluid as it travels through the plurality of variable-volume working pockets. In order to ensure that tips 46, 48 of non-orbiting and orbiting scroll members 34, 36 create a sufficient seal during compression of the working fluid, tip seals may be used.

Figure 2:
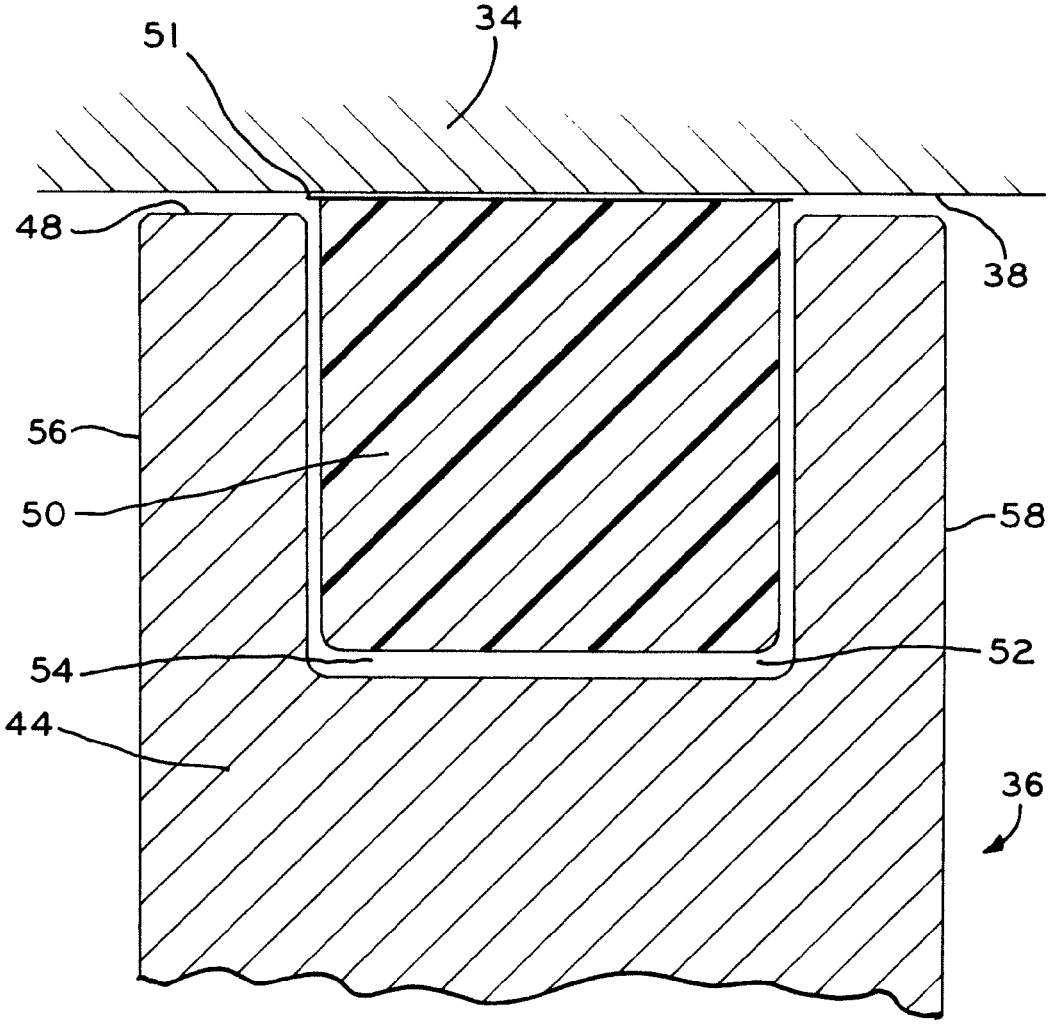
FIG. 2 PRIOR ART
FIG. 2 is an enlarged, fragmentary cross-section of an orbiting scroll member and an end plate of a non-orbiting scroll member depicting a tip seal according to a prior art design.

Referring to FIG. 2, tip seal 50, made in accordance with the prior art, is shown. Specifically, tip seal 50 is formed by injection molding in manner that results in the creation of flashing 51. Once formed, tip seal 50 is received within groove 52 formed in involute wrap 44 of orbiting scroll member 36. As shown in FIG. 2, groove 52 is slightly oversized relative to tip seal 50 and, during compression of fluid by scroll compressor 10, pressurized fluid enters groove 52 to force tip seal 50 upward, creating gap 54. Tip seal 50 contacts end surface 38 of non-orbiting scroll 34 and substantially lessens leakage of compressed fluid across the top of involute orbiting scroll wrap 44. However, while tip seal 50 is effective, the pressures on opposing sides of tip seal 50 are slightly equalized due to the opening provided by gap 54. Thus, if higher pressure working fluid is positioned on side 56 of involute wrap 44, it may travel to side 58 of involute wrap 44, which is at a lower pressure, lessening the efficiency of the compressor. Moreover, even if high pressure working fluid does not travel from side 56 to side 58 of involute wrap 44, the efficiency of the compressor may still be decreased due to higher pressure working fluid mixing with lower pressure fluid within groove 52.

Figure 3:
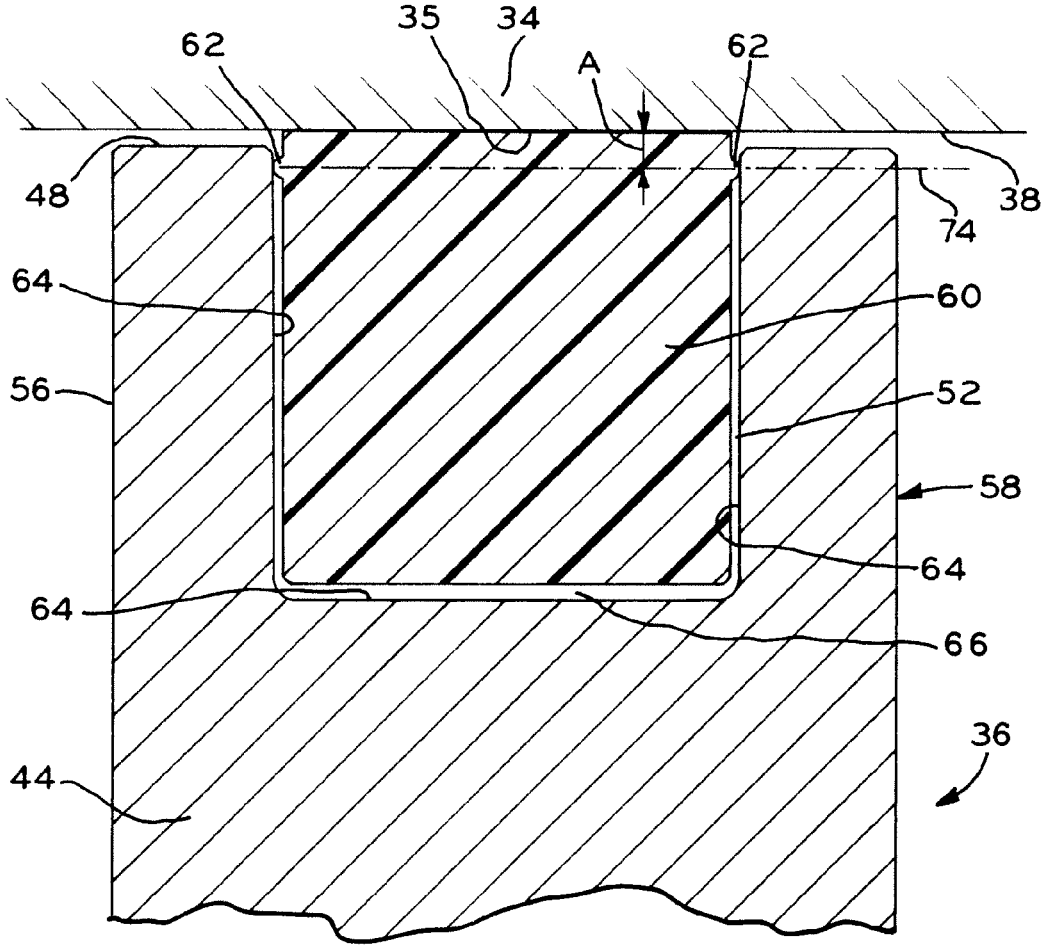
FIG. 3 is an enlarged, fragmentary cross-sectional view of an orbiting scroll member and an end plate of a non-orbiting scroll member including a tip seal made in accordance with the present invention.
Figure 4:
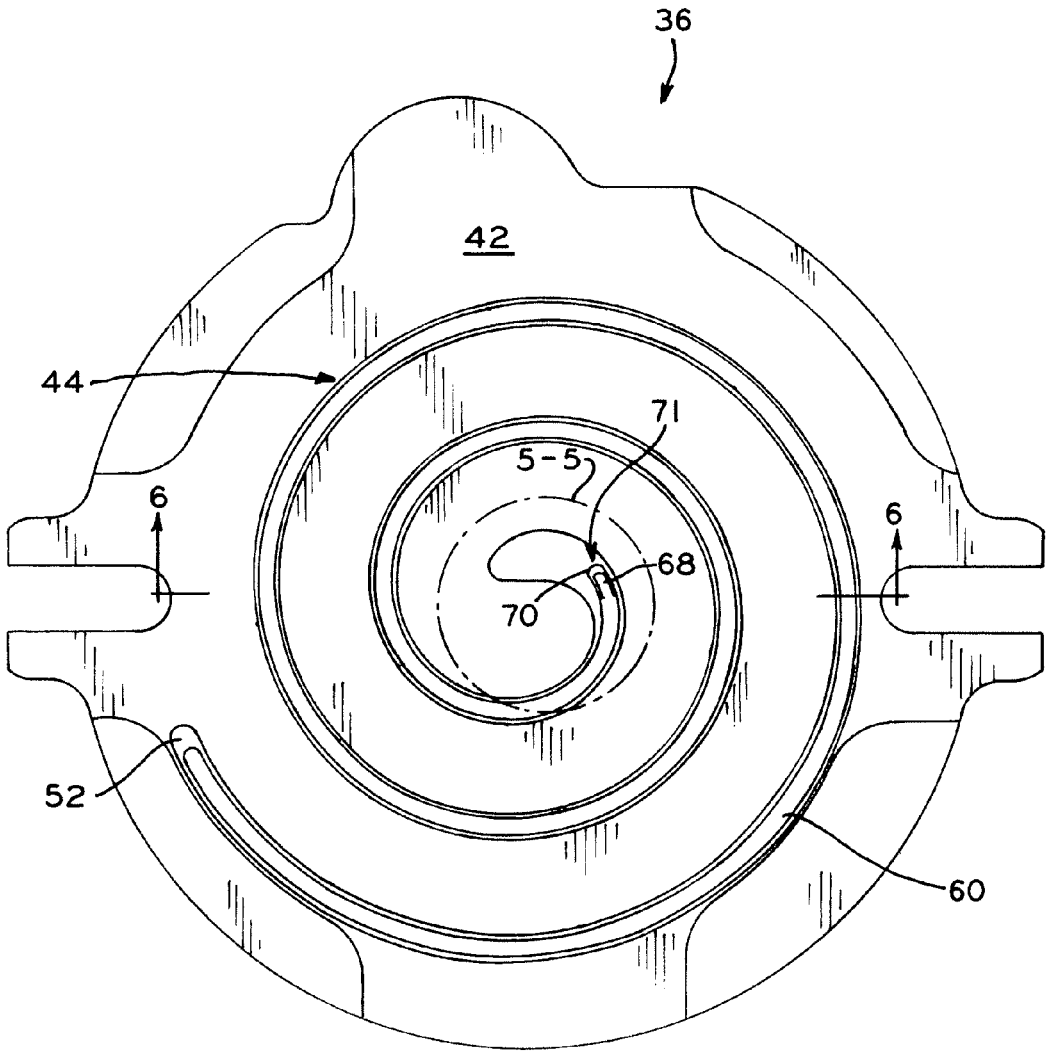
FIG. 4 is a plan view of the orbiting scroll member of FIG. 3.
Figure 6:
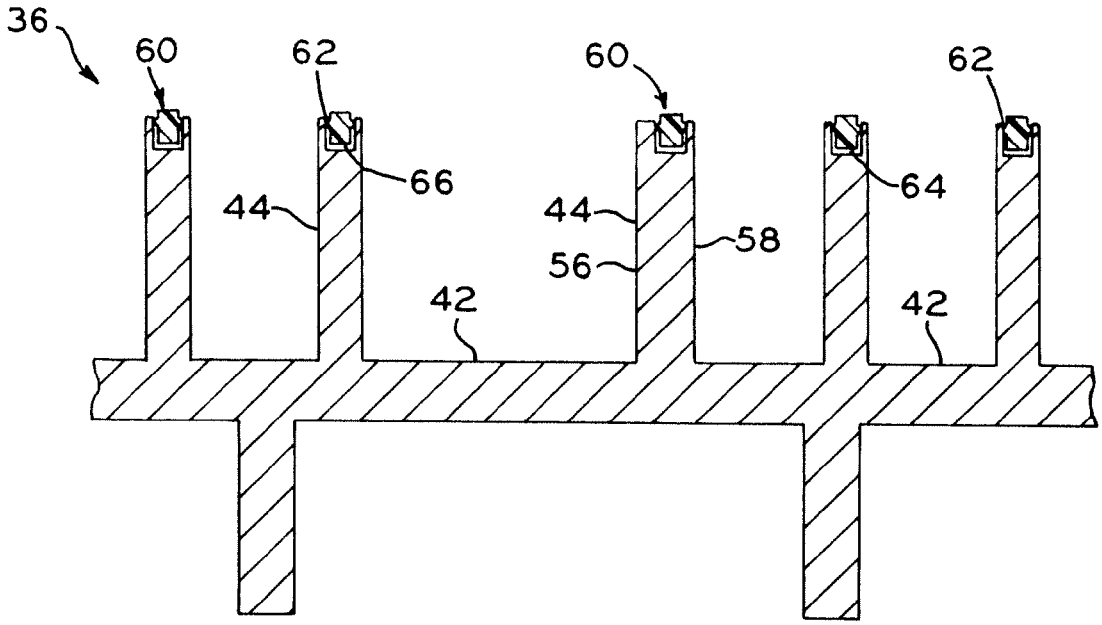
FIG. 6 is a fragmentary cross-sectional view of the orbiting scroll member of FIG. 4 taken along line 6-6 of FIG. 4.

In order to overcome these problems, tip seal 60 in accordance with the present invention, shown in FIG. 3, may be used. Tip seal 60, is configured to be received within groove 52 of involute orbiting scroll wrap 44. While described and depicted herein with specific reference to orbiting scroll member 36, tip seal 60 may also be utilized in combination with a groove formed in non-orbiting scroll member 34. Thus, both non-orbiting and orbiting scroll members 34, 36 may utilize tip seals 60 or only one of non-orbiting and orbiting scroll members 34, 36 may utilize tip seal 60. As shown in FIGS. 4 and 6, tip seal 60 runs substantially entirely along the length of involute wrap 44 of orbiting scroll member 36. Tip seal 60 includes projection 62 around substantially the entire periphery of tip seal 60 configured to sealingly engage inner walls 64 defining groove 52. Projection 62 may be formed a distance A from the top of tip seal 60. By altering distance A, the desired position and seating of projection 62 may be obtained. The interaction of projection 62 with walls 64 forms sealed pocket 66. Advantageously, by forming sealed pocket 66, time-dependent mixing of pressures on opposing sides 56, 58 of orbiting scroll wrap and the end 61 of tip seal 60 is prevented or greatly reduced. Thus, the sealed pocket underneath tip seal 60 defined by side and bottom walls 64 and projection 62 will be predominantly pressurized by discharge pressure at the inner end 71 of groove 52. This steadier and higher loading assures contact of tip seal 60 to the floor 35 of the opposing scroll face along the entire length of tip seal 60 for enhanced sealing to improve scroll compressor efficiency.

Figure 5:
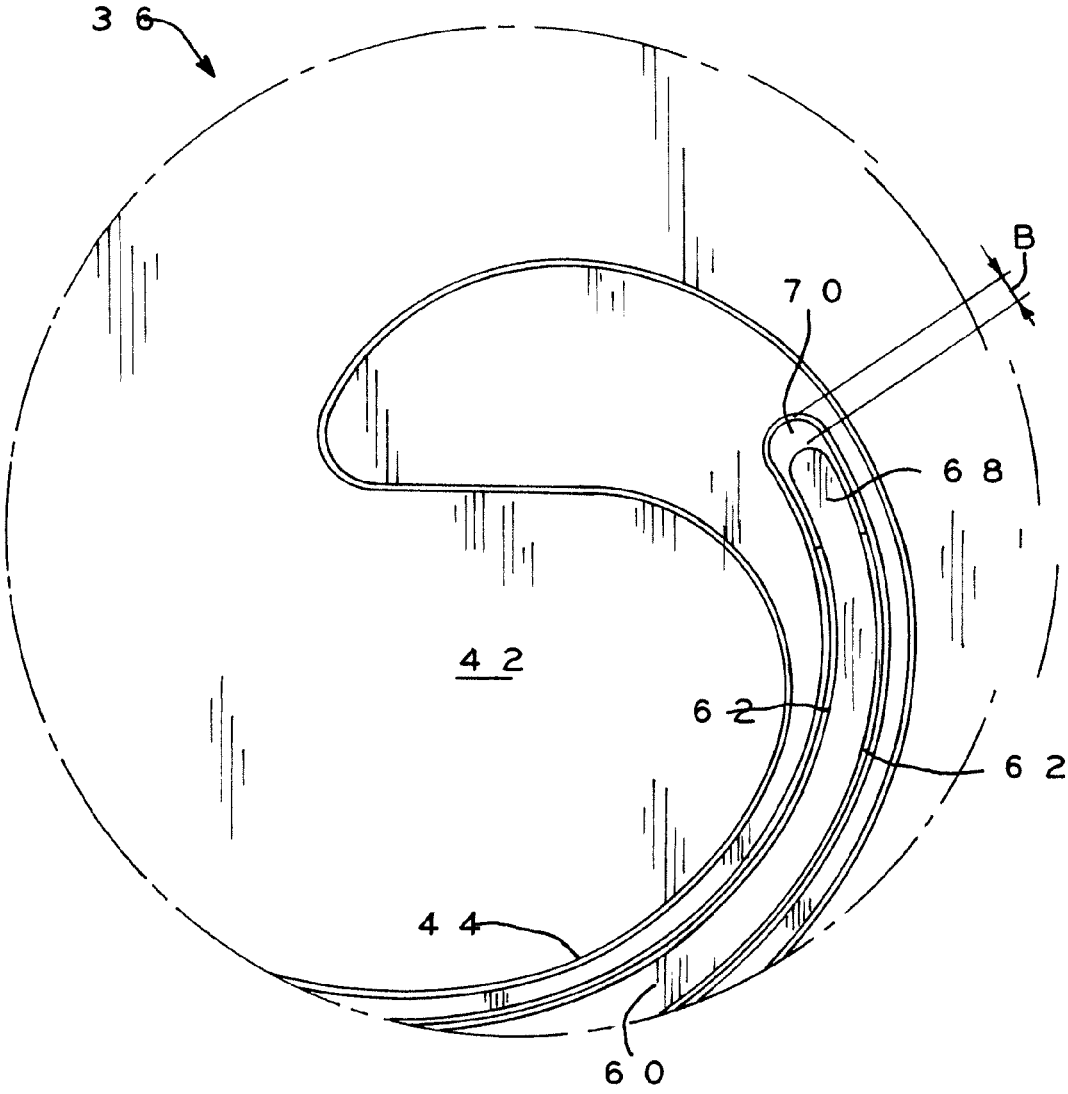
FIG. 5 is an enlarged plan view of the portion of FIG. 4 contained within circle 5-5 of FIG. 4.

Referring to FIGS. 4 and 5, in order to pressurize sealed pocket 66, end 68 of tip seal 60 is positioned substantially adjacent to the discharge chamber of the compressor. As shown in FIG. 4, end 68, of tip seal 60 lacks projection 62. This creates an inlet allowing discharge pressure working fluid to enter groove 52 at end 68 by passing between inner walls 64 of groove 52 and end 68 of tip seal 60 to pressurize sealed pocket 66 even if tip seal 60 should move to close gap B. By pressurizing sealed pocket 66, tip seal 60 is forced into engagement with flat end surface 38 of non-orbiting scroll member 34. In one exemplary embodiment, the length of tip seal 60 is slightly less than groove 52, creating a gap in the form of end space 70. In one exemplary embodiment, end space 70 is separated from end 68 of tip seal 60 by distance B. In one exemplary embodiment, distance B is at least 0.03, 0.04, or 0.05 inches and less than 0.06, 0.07, or 0.08 inches. By creating end space 70, working fluid at discharge pressure may enter also enter end space 70 and travel into sealed pocket 66 to pressurized sealed pocket 66. Additionally, by forming tip seal 60 to have a length that is less than the length of groove 52, the insertion and assembly of tip seal 60 with groove 52 is eased.

In one exemplary embodiment, tip seal 60 is manufactured by injection molding. The mold may be formed with the parting line, i.e., the point at which opposing halves of the mold come together, positioned at line 74 of FIG. 3. Line 74 may also be raised or lowered as needed to form projection 62 at the desired position. By utilizing the parting line of the mold to form projection 62, the creation of extraneous flashing, such as flashing 51 of tip seal 50 in FIG. 3, is avoided. Additionally, the edges of the opposing mold halves may be beveled to facilitate the formation of projection 62. In one exemplary embodiment, in order to ensure that the plastic properly fills along the mold parting line, the sprue used to inject the plastic into the mold is positioned below line 74 of FIG. 3.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A scroll compressor, comprising:

a motor including a stator and a rotor;

a driveshaft rotatably secured to said rotor;

a compression mechanism including a pair of interengaged scrolls each having an involute wrap, one of said scrolls rotatably connected to said drive shaft;

the wrap of at least one of said scrolls including a groove extending therealong and facing the other scroll, said groove defined by a pair of sidewalls and a bottom wall; and a tip seal received within said groove, said tip seal having a pair of projections extending laterally therefrom along substantially the entire length of said tip seal, said projections sealingly engaging the sidewalls to form a sealed chamber defined by said tip seal, said sidewalls and said bottom wall;

the sealed chamber formed by said tip seal, side walls and bottom wall having an inlet at an inner end portion of the groove through which pressurized working fluid enters the sealed chamber to pressurize the same and thereby force said tip seal into engagement with said other scroll.

2. The scroll compressor of claim 1, wherein:

the other scroll includes a second groove extending therealong and facing the scroll opposite thereto, said second groove defined by a pair of sidewalls and a bottom wall; and including a second tip seal received within said second groove and having a pair of projections extending laterally therefrom along substantially the entire length of said second tip seal and sealingly engaging the sidewalls of said second groove to form a sealed chamber defined by the second tip seal and said second groove sidewalls and bottom wall;

the sealed chamber formed by said second tip seal and the side walls and bottom wall of the second groove having a second inlet at an inner end portion of the second groove through which pressurized working fluid enters the sealed chamber formed by the second tip seal and second groove to pressurize the same and thereby force said second tip seal into engagement with said one scroll.

3. The scroll compressor of claim 2, wherein an inner end of each of said tip seals is spaced from an end of its respective groove at an inner end of the respective wrap thereby forming a gap which serves as the respective inlet to permit high pressure fluid to enter the respective groove.

4. The scroll compressor of claim 3, wherein the projections of each of said tip seals terminate short of the respective inner ends of the tip seals, thereby allowing pressurized fluid to enter the grooves even if the tip seals should move to close, off the respective gaps.

5. The scroll compressor of claim 1, wherein an inner end of said tip seal is spaced from an end of the groove at an inner end of its wrap to form a gap which serves as the inlet that permits high pressure fluid to enter the groove.

6. The scroll compressor of claim 5, wherein at least one of the projections of said tip seal terminates short of the inner end of said tip seal thereby allowing pressurized fluid to enter the groove even if the tip seal should move to close off the gap.

7. The scroll compressor of claim 5, wherein the projections of said tip seal terminate short of the inner end of said tip seal thereby allowing pressurized fluid to enter the groove even if the tip seal should move to close off the gap.

8. The scroll compressor of claim 1, wherein said tip seal includes a surface that faces outwardly from the groove and seals against a face of the other scroll, and wherein said projections are spaced inwardly from said surface.

9. The scroll compressor of claim 8, wherein said tip seal is injection molded and a parting line of mold halves forming said tip seal is positioned at said projections.

10. The scroll compressor of claim 1, wherein said tip seal is injection molded and a parting line of mold halves forming said tip seal is positioned at said projections.

11. A scroll compressor, comprising:

a motor including a stator and a rotor;

a driveshaft rotatably secured to said rotor;

a compression mechanism including a pair of interengaged scrolls each having an involute wrap, one of said scrolls rotatably connected to said drive shaft;

the wrap of at least one of said scrolls including a groove extending therealong and facing the other scroll, said groove defined by a pair of sidewalls and a bottom wall; and a tip seal made of a sealing material and terminating at a distal surface in engagement with said other scroll, said tip seal received within said groove, said tip seal having a pair of projections extending laterally therefrom along substantially the entire length of said tip seal, said projections sealingly engaging the sidewalls to form a sealed chamber defined by said tip seal, said sidewalls and said bottom wall, said projections being integral with said sealing material terminating at said distal surface.

12. The scroll compressor of claim 11, wherein:

the other scroll includes a second groove extending therealong and facing the scroll opposite thereto, said second groove defined by a pair of sidewalls and a bottom wall; and including a second tip seal made of a sealing material terminating at a second distal surface in engagement with said one scroll, said second tip seal received within said second groove and having a pair of projections extending laterally therefrom along substantially the entire length of said second tip seal and sealingly engaging the sidewalls of said second groove to form a sealed chamber defined by the second tip seal and said second groove sidewalls and bottom wall, said second tip seal projections being integral with said sealing material terminating at said second distal surface.

13. The scroll compressor of claim 12, wherein an inner end of each of said tip seals is spaced from an end of its respective groove at an inner end of the respective wrap thereby forming a gap to permit high pressure fluid to enter the respective groove.

14. The scroll compressor of claim 13, wherein the projections of each of said tip seals terminate short of the respective inner ends of the tip seals, thereby allowing pressurized fluid to enter the grooves even if the tip seals should move to close off the respective gaps.

15. The scroll compressor of claim 11, wherein an inner end of said tip seals is spaced from an end of the groove at an inner end of its wrap to form a gap that permits high pressure fluid to enter the groove.

16. The scroll compressor of claim 15, wherein at least one of the projections of said tip seal terminates short of the inner end of said tip seal thereby allowing pressurized fluid to enter the groove even if the tip seal should move to close off the gap.

17. The scroll compressor of claim 15, wherein the projections of said tip seal terminate short of the inner end of said tip seal thereby allowing pressurized fluid to enter the groove even if the tip seal should move to close off the gap.

18. The scroll compressor of claim 11, wherein said tip seal includes a surface that faces outwardly from the groove and seals against a face of the other scroll, and wherein said projections are spaced inwardly from said surface.

19. The scroll compressor of claim 18, wherein said tip seal is injection molded and a parting line of mold halves forming said tip seal is positioned at said projections.

20. The scroll compressor of claim 11, wherein said tip seal is injection molded and a parting line of mold halves forming said tip seal is positioned at said projections.

* * * * *

UNITED STATES PATENT AND TRADEMARK OFFICE

CERTIFICATE OF CORRECTION

PATENT NO. : 8,057,202 B2
APPLICATION NO. : 12/254278
DATED : November 15, 2011
INVENTOR(S) : Haller It is certified that error appears in the above-identified patent and that said Letters Patent is hereby corrected as shown below:

Claim 4, Column 5, Line 35, after "close" remove [,]

Signed and Sealed this
Seventeenth Day of January, 2012

David J. Kappos

David J. Kappos
*Director of the United States Patent and Trademark Office*